US006092691A

United States Patent [19]

Schuerholz et al.

[11] Patent Number: 6,092,691

[45] Date of Patent: Jul. 25, 2000

[54] PROCESS AND ARRANGEMENT FOR PROPORTIONING VISCOUS MATERIAL

[75] Inventors: Frank Schuerholz, Frontenhausen; Erwin Esterl, Eichendorf; Manfred Lehmann, Cologne, all of Germany

[73] Assignees: Bayerische Motoren Werke Aktiengesellschaft, Munich; Intec Bielenberg GmbH & Co, Kerpen, both of Germany

[21] Appl. No.: 09/043,673

[22] PCT Filed: Sep. 27, 1996

[86] PCT No.: PCT/EP96/04238

§ 371 Date: Mar. 25, 1998

§ 102(e) Date: Mar. 25, 1998

[87] PCT Pub. No.: WO97/12692

PCT Pub. Date: Apr. 10, 1997

[30] Foreign Application Priority Data

Sep. 30, 1995 [DE] Germany ..... 195 36 623

[51] Int. Cl.[7] ..... B67B 7/00

[52] U.S. Cl. ..... 222/1; 222/146.1; 222/146.2

[58] Field of Search ..... 222/146.1, 146.2, 222/309, 64, 1, 61

[56] References Cited

U.S. PATENT DOCUMENTS

| | | | |
|---|---|---|---|
| 3,662,927 | 5/1972 | Cocks | 222/309 |
| 4,530,862 | 7/1985 | Kerzel | 427/445 |
| 4,998,502 | 3/1991 | Schucker . | |
| 5,671,873 | 9/1997 | Hammerl et al. | 222/309 |

FOREIGN PATENT DOCUMENTS

| | | |
|---|---|---|
| 0 316 315 | 5/1989 | European Pat. Off. . |
| 0 425 866 | 5/1991 | European Pat. Off. . |
| 2 535 627 | 5/1984 | France . |
| 32 36 647 | 4/1984 | Germany . |
| 35 10 110 | 10/1986 | Germany . |
| 36 20 875 | 1/1988 | Germany . |
| 39 12 920 A1 | 12/1989 | Germany . |
| 42 09 065 C2 | 9/1993 | Germany . |
| WO 89/10206 | 11/1989 | WIPO . |
| WO 92/02306 | 2/1992 | WIPO . |

OTHER PUBLICATIONS

*Machine Market Publication*, 1998, vol. 49, entitled "Raupen legen" by Herbert R. Mayer et al., pp. 3–6.

KUKA Report entitled "Abdichten von Lkw–Türen".

*Industrie–Anzeiger*, No. 42, p. 15, 1989 entitled "Robert trägat Kleber auf".

Kern–Liebers drawing.

*Primary Examiner*—Kevin Shaver
*Assistant Examiner*—David Deal
*Attorney, Agent, or Firm*—Evenson, McKeown, Edwards & Lenahan, PLLC

[57] ABSTRACT

In order to obtain an optimal application of viscous material, such as an adhesive or a sealing agent. The process and apparatus combines the proportional metering device and the outlet valve to form a constructional unit. A static mixing tube is integrated into the filling opening. The feed pipe is partially tempered and therefore maintains the viscous material situated in the feed pipe at a constant temperature.

18 Claims, 2 Drawing Sheets

PROCESS AND ARRANGEMENT FOR PROPORTIONING VISCOUS MATERIAL

BACKGROUND AND SUMMARY OF THE INVENTION

The invention relates to a process for proportioning thick matter such as a viscous material which is delivered under pressure from a supply, is then proportioned and is applied by way of a controlled outlet valve to an application point and to an arrangement for proportioning viscous material, consisting of at least one storage container and a feed pump which is connected with a proportional metering device by way of a feed pipe as well as of a controlled outlet valve.

In many fields of technology, particularly in the automated manufacturing of motor vehicle bodies, it is required to apply viscous material, particularly sealing agents and adhesives, to certain surfaces. For example, in the case of motor vehicles, threads or thin strips of sealing agents or adhesives are applied along edges, lock seams or seams of motor vehicle body parts.

This application can take place manually as well as by programmed automatic manipulating machines, as described, for example, in German Patent document DE-C 32 36 647.

In practice, considerable difficulties with such application operations are encountered because, on the one hand, a fast manufacturing is desired and, on the other hand, a sufficient application, which is as uniform as possible, of the viscous material is required. In this case, it should be taken into account that the same types of viscous material will often have different flow properties because of a different viscosity, specifically also when this is viscous material from the same manufacturing batch which is processed within a very short time. This considerably impairs the uniform delivery of the viscous material or a delivery which can be changed in a proportioned manner.

Despite large expenditures, the known arrangements which have very sensitive control circuits do not constantly achieve the desired result because of their high susceptibility.

There is therefore needed a process and an arrangement by which the flow properties of viscous material are influenced in a simple manner such that, when the nozzle openings have the same sizes, the same quantities can always be delivered per unit of time.

According to the invention, these needs are met by a process and apparatus for proportioning viscous material which is delivered under pressure from a supply, is then proportioned and is applied by way of a controlled outlet valve to an application point. The proportioning takes place directly in front of the outlet valve separately for each quantity to be applied. Because of the fact that the outlet valve and the proportioning are directly connected with one another, it is possible to proportion immediately before the application and to then discharge directly. This will eliminate the previous long flow paths between the proportioning and the outlet valve which have led to inaccuracies of the outflow rate per unit of time. This also eliminates the additional feed pipes. Another advantage is the fact that the viscous material to be discharged can be sufficiently mixed or sheared immediately during the filling of the proportioning device.

A reinforcement of the mixing device or the shearing of the viscous material is achieved by providing a mixing section, for example, a static mixer tube can be installed in the inlet of the proportioning device.

In a further particularly advantageous embodiment of the process the proportioning takes place by means of a purely volumetric control in that, in the case of deviations in the application quantity during one discharge operation, the subsequent discharge operation is controlled to a desired value. This embodiment minimizes the control expenditures and nevertheless achieves excellent results.

By means of the further development, viscosity differences caused by temperature changes are avoided.

A still further development has the advantage that the previously known switching valve at the outlet of the proportional metering device can be eliminated and the outlet valve can be connected directly to the delivery chamber of the proportional metering device. This further minimizes the control expenditures.

Another development according to the invention achieves the advantage that the viscous material is continuously delivered into the proportional metering device so that viscous material does not have to be stored there for extensive waiting periods which, in turn, would result in differences in viscosity. This ensures that there is sufficient mixing and shearing immediately before the application of the viscous material.

In a further development according to the invention, the differences in viscosity resulting from variations in temperature are avoided. In this case, it is not required to temper the whole feed pipe between the storage container and the proportional metering device. It is sufficient to temper thirty (30) times the application volume. "Tempering" in this case is the achieving of a constant temperature; that is, a heating or cooling depending on the environmental influences.

The further development according to the invention describes a preferred development for the tempering. In this case, it was also found to be effective to include the proportional metering device and the outlet valve.

The present invention describes a simple possibility of providing a volumetric control.

By means of the pressure relief of the flow rates during production stoppages, the thixotropy can be kept constant.

By further developing the invention, the mixing and flexing of the viscous material to be proportioned will be promoted further.

Other objects, advantages and novel features of the present invention will become apparent from the following detailed description of the invention when considered in conjunction with the accompanying drawings.

DETAILED DESCRIPTION OF THE DRAWINGS

Figure 1:
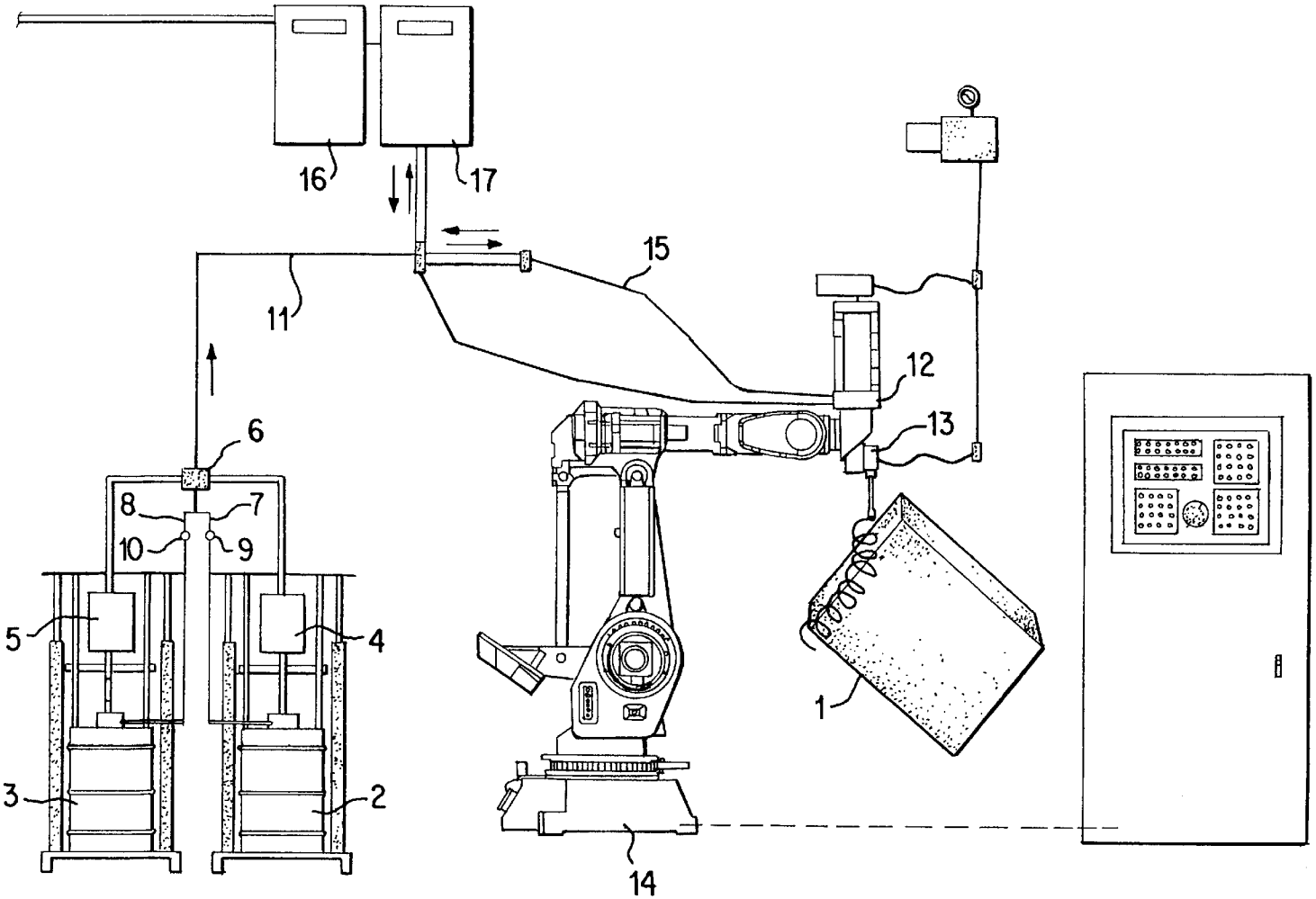
FIG. 1 is a schematic view of an arrangement of a system for proportioning viscous material according to the present invention.

The invention will be explained by way of the application of an adhesive to a component 1 which may, for example, be part of a motor vehicle. Of course, the invention is applicable to other components as well.

The adhesive is provided in two barrels 2 and 3. Each barrel is provided with a feed pump 4, 5. Their two delivery pipes meet in junction 6 from which a return pipe 7, 8 also branches off which leads to each barrel 2, 3. A pressure relief valve 9, 10 is also installed in each return flow pipe. Both feed pumps 4, 5 are operated successively such that delivery only takes place to one barrel at a time.

A feed pipe 11 extends from the junction 6 to a proportional metering device 12.

During the stoppage/readiness time of the system, the feed pipe 11 can have its feed pressure relieved by the pressure relief valves 9, 10 so that a constant thixotropy is achieved.

The proportional metering device 12 is directly connected with an outlet valve 13. Both the proportional metering device 12 and the outlet valve 13 are carried by an automatic manipulator 14 and are guided in accordance with a preprogrammed path along the application surfaces of the workpiece 1. The control of the proportional metering device 12 and the outlet valve 13 takes place by way of the controlling of the automatic manipulator 14 so that no separate control is required.

A portion of the length of the feed pipe 11 as well as the proportional metering device 12 and the outlet valve 13 are a component of a heat transfer circulation system 15. This heat transfer circulation system 15 contains a heating device 16 as well as a recooling device 17 and a feed pump (which is not shown in detail). As a result, it is possible to always keep the adhesive at a constant temperature.

As clearly illustrated in FIG. 1, the whole feed pipe 11 is not tempered, but rather only a portion thereof. It was found to be sufficient to temper approximately thirty (30) times the application volume which, in practice, corresponds to approximately 6 mm of feed pipe.

Figure 2:
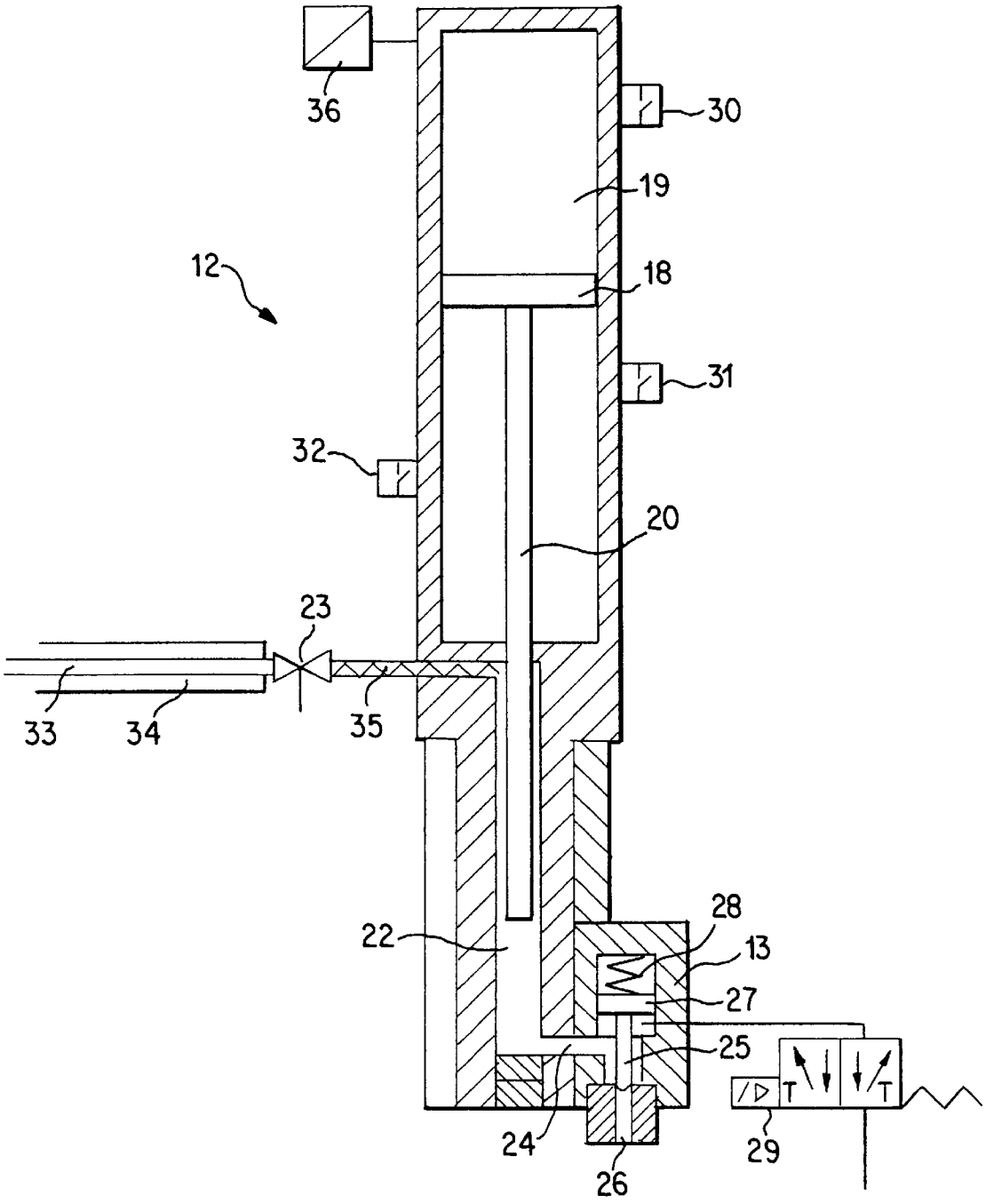
FIG. 2 is a schematic cross-sectional view of the proportional metering device with a flanged-on outlet valve according to the invention.

In FIG. 2, the proportional metering device 12 with the flanged-in outlet valve is illustrated in detail.

The proportional metering device 12 is driven pneumatically. For this purpose, it has a piston 18 which is movably arranged in a delivery space 19 and is supplied with pressurized air by way of a proportional valve 36 in a controlled manner.

The piston is connected with a piston rod 20 and is extended beyond the delivery space 19 into a metering chamber 22.

The feed pipe 11 is connected to the metering chamber 22 by way of a shut-off valve 23 and a static mixing pipe 35.

An outlet 24 from the metering chamber 22 leads directly into the outlet valve 13 above a valve needle 25. When the outlet valve 13 is open, the adhesive is discharged by way of a nozzle 26.

The outlet valve 13 is also controlled pneumatically. For this purpose, the nozzle needle 25 is connected with a control piston 27 which opens against the force of a spring 28. The outlet valve 13 is controlled by way of a 2/2-way valve 29.

For the volume control, the proportional metering device 12 has three proximity switches 30, 31 and 32 which detect the piston path. In this case, the proximity switch 30 detects the inoperative position of the piston 18. In this position, the shut-off valve 23 can be opened and the metering chamber 22 can be filled.

The proximity switch 31 detects the minimal application amount; that is, when the piston 18 reaches this position, the piston rod 20 has mixed the adhesive charged in the metering chamber 22 but has pushed out only a small amount of adhesive by way of the opened outlet valve 13.

The proximity switch 32 characterizes the maximal application amount; that is, when the piston 18 reaches this proximity switch, the piston rod 20 is situated close to the lower end of the metering chamber 22. Thus, the largest-possible amount of adhesives has been pushed out through the opened outlet valve 13.

Correspondingly, the amount of adhesive to be applied can also be monitored and controlled by way of these three proximity switches. For this purpose, the proximity switches 30 to 32 are arranged with respect to one another corresponding to the desired quantity to be applied. When, during an application, the piston reaches a position between proximity switch 31 and 32, that is, it overruns the proximity switch 31, but does not reach the proximity switch 32, the application quantity is correct.

If the piston 18 reaches only the proximity switch 31, only the minimal quantity has been discharged and the proportioning pressure can be increased for the subsequent application by way of the proportioning valve 36.

When, after the application of the adhesive, the piston reaches the maximum switch 32, slightly more than the required amount has been pushed out. For the next application operation, the proportioning pressure in the delivery space 19 will then be lowered. If, during an application operation, the proximity switch 31 is not reached, or the piston moves farther downward beyond the proximity switch 32, the application quantity is incorrect in both cases and the system will report a disturbance.

FIG. 2 also illustrates a possibility of a tempering also in the case of the feed line 11 in that the feed line has a double-walled construction. In this case, a heat transfer medium can then circulate between its interior wall 33 and its exterior wall 34 and thus hold this feed line section at a constant temperature. Naturally, the switching valve 23 can also be integrated in the heat transfer medium circulation system, as well as the metering chamber 22 of the proportional metering device and the area around the nozzle needle 25 of the outlet valve 13.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for dispensing viscous material, the process comprising the steps of:

delivering the viscous material under pressure from a supply;

proportioning said viscous material via a proportional metering device immediately upstream of a controlled outlet valve separately for each quantity to be applied;

tempering both the proportional metering device and the controlled outlet valve; and subsequently applying said proportioned and tempered viscous material from said controlled outlet valve to an application point.

2. The process according to claim 1, wherein prior to said proportioning step, the process includes the step of mixing the viscous material.

3. The process according to claim 2, wherein said proportioning step further includes the steps of:

performing a purely volumetric control such that, in case of deviations in an application quantity during one discharge operation, a subsequent discharge operation is controlled to a desired value.

4. The process according to claim 1, wherein said proportioning step further includes the steps of:

performing a purely volumetric control such that, in case of deviations in an application quantity during one discharge operation, a subsequent discharge operation is controlled to a desired value.

5. The process according to claim 1, further comprising the step of tempering a feed line along a length corresponding to approximately 30 times an application volume of the proportional metering device between the supply and the proportional metering device.

6. The process according to claim 1, further comprising the step of reducing a delivery pressure during a readiness state of the device.

7. An arrangement for dispensing viscous material, comprising:

at least one storage container;

a feed pump coupled to said at least one storage container;

a proportional metering device connected to said feed pump via a feed pipe;

a controlled outlet valve mounted directly on said proportional metering device;

a tempering unit coupled to temper both the proportional metering device and the controlled outlet valve;

whereby said proportional metering device separately proportions the viscous material immediately upstream of the controlled outlet valve for each quantity to be applied.

8. An arrangement according to claim 7, wherein said controlled outlet valve is controlled separately via a switching valve.

9. An arrangement according to claim 8, further comprising a shut-off valve arranged in said feed pipe upstream of said proportional metering device.

10. The arrangement according to claim 8, wherein said feed pipe is tempered approximately 30 times an application volume of the proportional metering device beginning at said proportional metering device and extending upstream.

11. An arrangement according to claim 7, further comprising a shut-off valve arranged in said feed pipe upstream of said proportional metering device.

12. The arrangement according to claim 11, wherein said feed pipe is tempered approximately 30 times an application volume of the proportional metering device beginning at said proportional metering device and extending upstream.

13. The arrangement according to claim 7, wherein said feed pipe, is tempered approximately 30 times an application volume of the proportional metering device beginning at said proportional metering device and extending upstream.

14. The arrangement according to claim 13, wherein said tempering comprises a heat transfer medium circulation system in which heating and cooling devices for a heat transfer medium are installed.

15. The arrangement according to claim 7, wherein said proportional metering device with said controlled outlet valve is integrated in the tempering device comprised of a heat transfer medium circulation system.

16. The arrangement according to claim 7, wherein said proportional metering device is equipped with a stroke control.

17. The arrangement according to claim 7, wherein a pressure relief valve is installed in said feed pipe.

18. The arrangement according to claim 7, wherein a static mixing tube is provided between a shut-off valve and a metering chamber.

* * * * *